US011166533B2

(12) United States Patent
Chen et al.

(10) Patent No.: US 11,166,533 B2
(45) Date of Patent: Nov. 9, 2021

(54) OVER-TEMPERATURE PROTECTION STRUCTURE AND HAIR DRYING APPARATUS

(71) Applicant: Shenzhen Soocas Technology Co., Ltd., Shenzhen (CN)

(72) Inventors: Xu Chen, Shenzhen (CN); Fandi Meng, Shenzhen (CN)

(73) Assignee: Shenzhen Soocas Technology Co., Ltd., Shenzhen (CN)

( * ) Notice: Subject to any disclaimer, the term of this patent is extended or adjusted under 35 U.S.C. 154(b) by 107 days.

(21) Appl. No.: 16/539,396

(22) Filed: Aug. 13, 2019

(65) Prior Publication Data

US 2020/0128936 A1 Apr. 30, 2020

(30) Foreign Application Priority Data

Oct. 31, 2018 (CN) ..... 201811288640.1

(51) Int. Cl.
*A45D 20/12* (2006.01)

(52) U.S. Cl.
CPC ..... *A45D 20/12* (2013.01); *A45D 2200/152* (2013.01)

(58) Field of Classification Search
CPC ..... A45D 20/12; A45D 20/08; A45D 20/30; A45D 20/38; A45D 2200/152; A45D 2200/128
USPC ..... 34/96, 283, 287; 219/222
See application file for complete search history.

(56) References Cited

U.S. PATENT DOCUMENTS

| | | | | |
|---|---|---|---|---|
| 3,816,706 A * | 6/1974 | Meywald | A45D 20/08 219/537 |
| 4,341,946 A * | 7/1982 | Ohnmacht | G02B 26/12 338/293 |
| 4,602,143 A * | 7/1986 | Mack | A45D 1/28 132/232 |
| 2017/0164709 A1* | 6/2017 | Laveni | A45D 20/12 |

FOREIGN PATENT DOCUMENTS

| | | |
|---|---|---|
| CN | 206261070 U * | 6/2017 |
| JP | 2017104554 | 6/2017 |
| KR | 101285469 | 7/2013 |

OTHER PUBLICATIONS

"Office Action of Korea Counterpart Application", dated Dec. 17, 2020, p. 1-p. 4.

* cited by examiner

*Primary Examiner* — John P McCormack
(74) *Attorney, Agent, or Firm* — JCIP Global Inc.

(57) ABSTRACT

An over-temperature protection structure and a hair drying apparatus is provided. The over-temperature protection structure includes a main body, a heater and an over-temperature protector; the heater includes an inner layer and a heating element, the inner layer being arranged on an inner side of the heating element and configured to support the heating element. Therefore, when the temperature of the heater is relatively high, the heater and the power source will be disconnected and the heater will cease to work, avoiding damaging the heater and surrounding elements because of overheat, thereby protecting the whole hair drying apparatus.

13 Claims, 8 Drawing Sheets

OVER-TEMPERATURE PROTECTION STRUCTURE AND HAIR DRYING APPARATUS

CROSS-REFERENCE TO RELATED APPLICATION

This application claims priority of Chinese Application No. 201811288640.1 filed on Oct. 31, 2018. The patent application is hereby incorporated by reference in its entirety.

TECHNICAL FIELD

The present disclosure relates to the field of handheld appliance, more particularly, to an over-temperature protection structure and a hair drying apparatus.

BACKGROUND

Hair drying apparatuses are mainly for hair drying and conditioning, and also for drying and aesthetic purpose in other aspects. The existing hair drying apparatuses generally use a motor to drive the fan to rotate. While the fan is rotating, air may enter a fluid inlet and flows out from a flow outlet to form a fluid, thereby realizing purposes such as drying and conditioning.

Heaters are for heating up fluid entering via the fluid inlet, such that the fluid flowing out from the fluid outlet possesses a certain temperature. In the process of the fluid heated by the heater flowing out, temperature of elements surrounding the heater would also be raised up. When the temperature of the fluid and the heater is raised to a certain value, surrounding elements may be affected and even be damaged.

SUMMARY

Technical problem of the present application aims to solve is providing an over-temperature protection structure and a hair drying apparatus for dealing with the technical issue that when temperature of a hair dryer and a heater thereof is overheat, surrounding elements may be damaged.

In order to solve the problems above, on one hand, an embodiment of the present disclosure provides an over-temperature protection structure, applied to a hair drying apparatus, which includes a main body, a heater and an over-temperature protector, a fluid channel being formed inside the main body, the heater being arranged inside the fluid channel and configured to heat up fluid medium inside the fluid channel;

the heater includes an inner layer and a heating element, the inner layer being arranged on an inner side of the heating element and configured to support the heating element, the first over-temperature protector being arranged on the inner side of the heating element.

Optionally, the inner layer is a plastic layer and configured with a first through hole, the first over-temperature protector arranged in the first through hole.

Optionally, an outer wall of the inner layer is configured with a first mounting column; the first over-temperature protector includes a first temperature detection element and a first connector connected to the first temperature detection element, the first temperature detection element arranged inside the first through hole, the first connector connected to the first mounting column.

Optionally, the over-temperature protection structure further includes a second over-temperature protector, the second over-temperature protector arranged on the inner side of the heating element.

Optionally, the first over-temperature protector is configured to cut off connection between the heater and a power source if temperature inside the heater is higher than a first preset value; the second over-temperature protector is configured to cut off connection between the heater and the power source if temperature inside the heater is higher than a second preset value, and reconnect the heater and the power source if temperature inside the heater is lower than the second preset value;

the second preset value is lower than the first preset value.

Optionally, the inner layer is configured with a second through hole, the second over-temperature protector arranged inside the second through hole.

Optionally, an outer wall of the inner layer is arranged with a second mounting column; the second over-temperature protector includes a second temperature detection element and a second connector connected to the second temperature detection element; the second temperature detection element is arranged inside the second through hole, the first connector connected to the second mounting column.

Optionally, an outer wall of the inner layer is configured with a supporter, the heating element erected on the supporter.

Optionally, the inner layer is a cylinder; a plurality of supporters are provided; the heating element includes a plurality of heating wires; the plurality of supporters are arranged at intervals along a circumferential direction of the inner layer; the supporters extend along an axial direction of the inner layer; the supporters include a plurality of locating slots extending along a radial direction of the inner layer;

the plurality of heating wires are arranged at intervals along an axial direction of the inner layer, locating elements contained in the locating slots are formed on the heating wires.

Optionally, a first avoidance space for containing the first over-temperature protector is arranged on the heating wires.

Optionally, a second avoidance space for containing the second over-temperature protector is arranged on the heating wires.

Optionally, at least one of the supporters are arranged between the first avoidance space and the second avoidance space along a circumferential direction of the inner layer, the heating wires arranged on at least one of the locating elements arranged between the first avoidance space and the second avoidance space.

Optionally, the heater further includes an outer layer, the heating element arranged between the inner layer and the outer layer.

In the over-temperature protection structure of the hair drying apparatus provided by the embodiments above, the first over-temperature protector is arranged inside the heater, therefore, when the temperature of the heater is relatively high, the heater and the power source will be disconnected and the heater will cease to work, avoiding damaging the heater and surrounding elements because of overheat, thereby protecting the whole over-temperature protection structure and the hair drying apparatus. The first over-temperature protector of the hair drying apparatus is arranged inside the heater, therefore, the temperature standard for disconnecting the power source for the first over-temperature protector is the temperature inside the heater, thereby revealing the temperature of the heater more vividly, which improves safety and use performances of the hair drying apparatus.

On the other hand, another embodiment of the present application provides a hair drying apparatus which includes the over-temperature protection structure described above.

BRIEF DESCRIPTION OF THE ACCOMPANYING DRAWINGS

Reference numbers used in the specification are as follows;

10. Hair drying apparatus;

100. Handle; 101. First fluid channel; 103. First section; 105. Second section; 110. First end; 120. Second end; 112. First fluid inlet;

200. Main body; 201. Second fluid channel; 210. First end portion; 212. Second fluid inlet; 220. Second end portion; 222. First fluid outlet; 224. Second fluid outlet; 230. Housing; 240. Tube body;

300. Fan assembly;

400. Heater; 410. Inner layer; 4102. First mounting hole; 4104. First mounting column; 4106. Second mounting column; 4108. Supporter; 41082. Locating slot; 420. Outer layer; 430. Heating wire; 4302. Locating element; 4304. First U-shape structure; 4306. Second U-shape structure;

500. First over-temperature protector; 510. First temperature detection element; 520. First connector;

600. Second over-temperature protector; 610. Second temperature detection element; 620. Second connector;

700. Temperature detector.

DETAILED DESCRIPTION OF ILLUSTRATED EMBODIMENTS

In order to better understand the present disclosure, the application will be described more comprehensively in accompany with associated drawings. The drawings merely provide preferable embodiments. However, the present disclosure may be carried out in various alternative ways, but not exclusive to the embodiments described herein. Conversely, the embodiments provided in the specification aim for more thorough understanding of the present disclosure.

Figure 1:
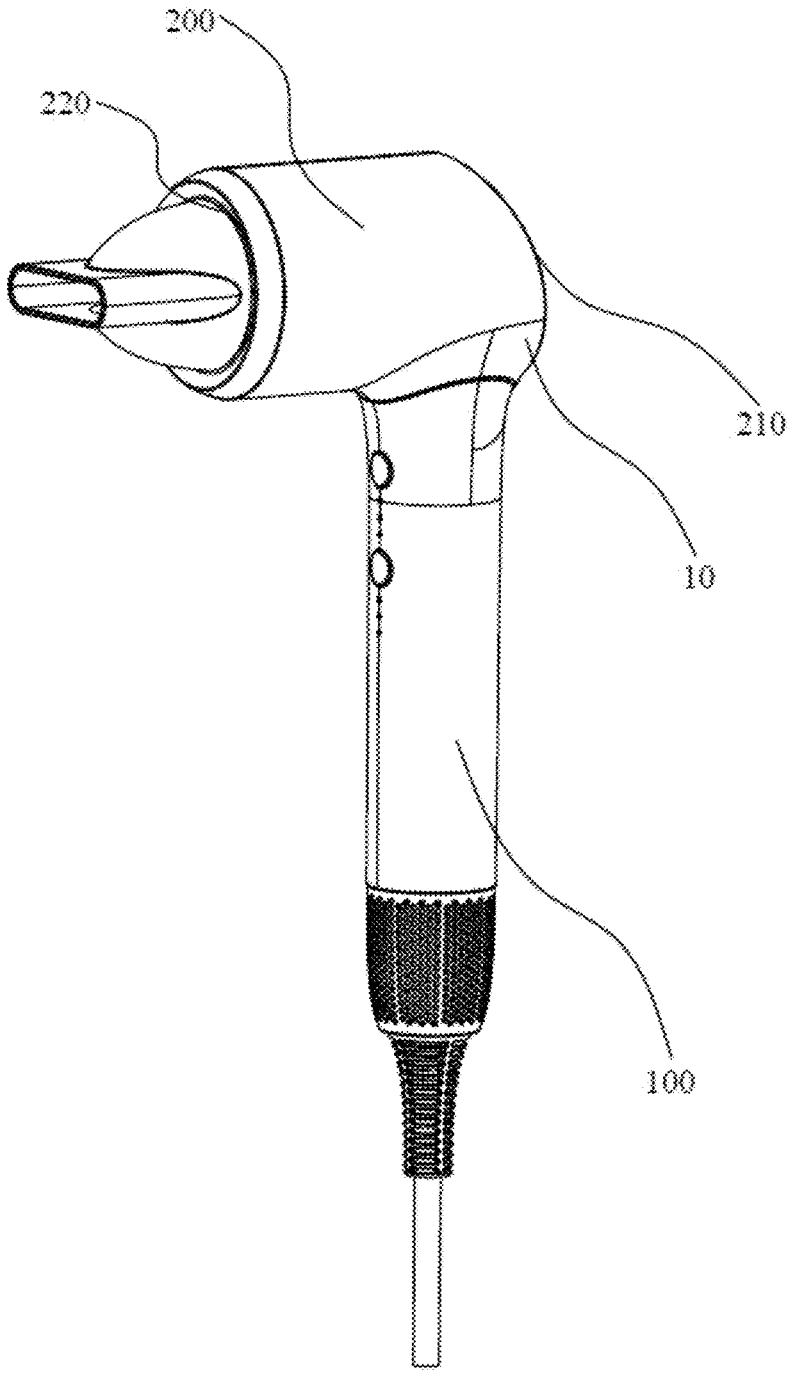
FIG. 1 is a structural schematic view of a hair drying apparatus according to an embodiment.
Figure 2:
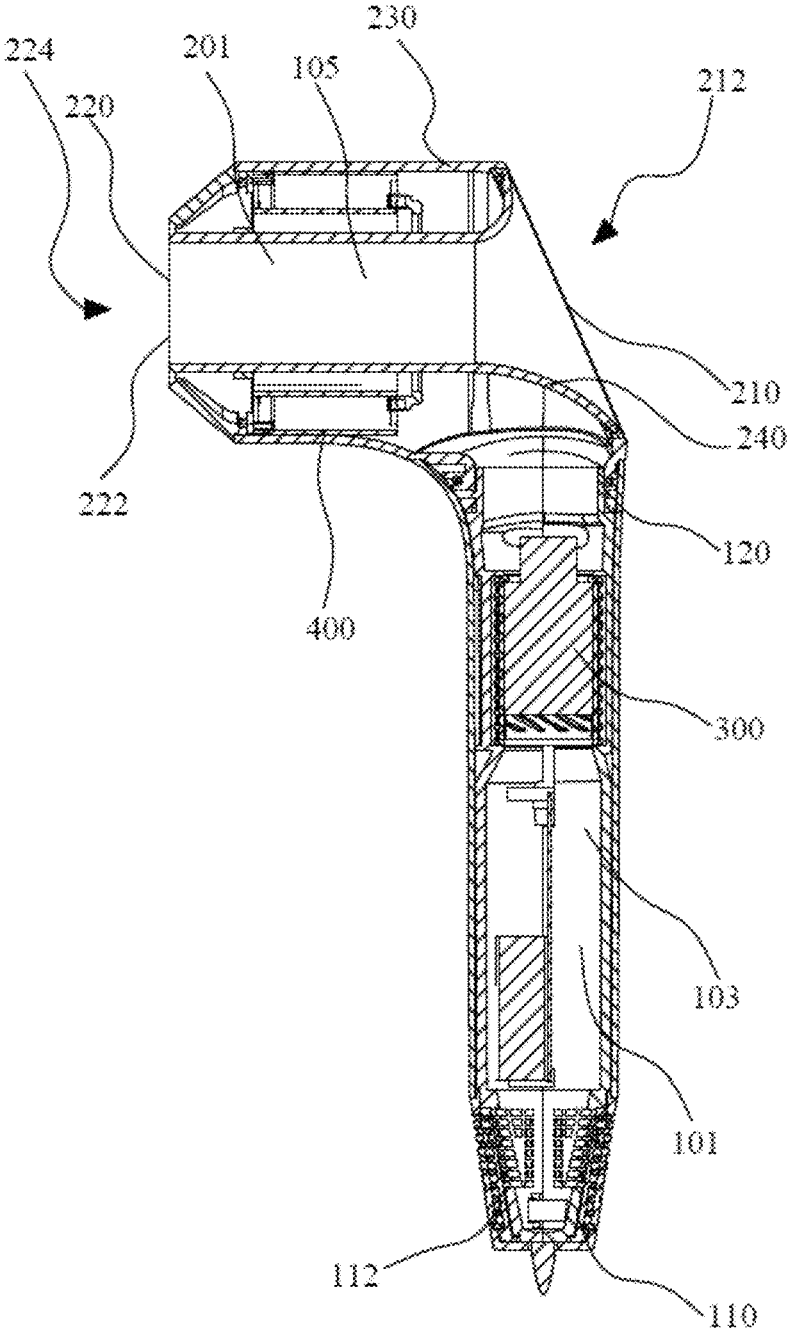
FIG. 2 is a section schematic view of the hair drying apparatus according to an embodiment.

As shown in FIGS. 1-2, a hair drying apparatus 10 in one embodiment includes a handle 100 and a main body 200. The main body 200 is connected to the handle 100. The handle 100 and the main body 200 provide a first fluid channel 101 for fluid to flow through. The handle 100 includes a first fluid inlet 112. The main body 200 includes a first fluid outlet 222. The first fluid inlet 112 and the first fluid outlet 222 communicate with each other to form the first fluid channel 101. The first fluid inlet 112 and the first fluid outlet 222 are respectively designed for the fluid to flow into and out of the first fluid channel 101.

As shown in FIGS. 1-2, in one embodiment, the handle 100 includes a first end 110 and a second end 120 arranged opposite to each other. The second end 120 of the handle 100 is connected to the main body 200. The first fluid inlet 112 is arranged at the first end 110 of the handle 100. The main body 200 includes a first end portion 210 and a second end portion 220 arranged opposite to each other. The first fluid outlet 222 is arranged at the second end portion 220 of the main body 200.

Furthermore, in the present embodiment, the first fluid channel 101 is not linear. The first fluid channel 101 includes a first section 103 and a second section 105 communicated with each other. An extension direction of the first section 103 is perpendicular to that of the second section 105. The first section 103 is located inside the handle 100. The second section 105 is located inside the main body 200. Therefore, the fluid flows along the first section 103 of the first fluid channel 101 through the handle 100, and then flows along the second section 105 of the first fluid channel 101 through the main body 200.

As shown in FIGS. 1-2, in one embodiment, the hair drying apparatus 10 further includes a fan assembly 300. The fan assembly 300 is located inside the first fluid channel 101. In the present embodiment, the fan assembly 300 is located in the first section 103 of the first fluid channel 101. The fan assembly 300 is configured to suction the fluid, such that the fluid flows through the first fluid inlet 112 and into the first fluid channel 101.

As shown in FIG. 2, in one embodiment, the main body 200 further includes a first fluid inlet 212 and a second fluid outlet 224. The first fluid inlet 212 and the second fluid outlet 224 communicate with each other to form a second fluid channel 201. The second fluid inlet 212 and the second fluid outlet 224 are respectively designed for another fluid to flow into and out of the second fluid channel 201. In the present embodiment, the second fluid inlet 212 is located at the first end portion 210 of the main body 200. The second fluid outlet 224 is located at the second end portion 220 of the main body 200.

While the fan assembly 300 is running, the fan assembly 300 suctions a fluid, such that the fluid flows through the first fluid inlet 112 into the first fluid channel 101 and reaches the first fluid outlet 222. The fluid flowing through the main body 200 and out of the first fluid outlet 222 makes the other fluid at the second fluid inlet 212 be suctioned and drawn into the second fluid channel 201, and flows along the second fluid channel 201 towards the second fluid outlet 224. The other fluid that flows out through the second fluid outlet 224 and the fluid that flows out through the first fluid outlet 222 converge at the second end portion 220 of the main body 200, increasing fluid outflow rate of the hair drying apparatus 10.

As shown in FIG. 2, in one embodiment, the main body 200 includes a housing 230 and a tube body 240 passing through the housing 230. The second fluid channel 201 is defined by the tube body 240. The second fluid channel 201 extends within the tube body 240 from the second fluid inlet 212 to the second fluid outlet 224. The second section 105 of the first fluid channel 101 is defined by a gap between the tube body 240 and a sidewall of the housing 230. A cross section of the first fluid outlet 222 is of annular shape. The first fluid outlet 222 extends around the second fluid channel 201.

As shown in FIG. 2, in one embodiment, the hair drying apparatus 10 further includes a heater 400. The heater 400 is arranged inside the first fluid channel 101. In the present embodiment, the heater 400 is located in the second section 105 of the first fluid channel 101. The heater 400 extends around the tube body 240. The heater 400 is configured to heat up the fluid within the first fluid channel 101.

In the present embodiment, for illustrative purpose, an end of the heater 400 close to the first fluid outlet 222 is defined as a downstream end of the heater 400, the other end of the heater 400 distal to the first fluid outlet 222 defined as an upstream end of the heater 400. The fluid flows through the first fluid inlet 112 into the first fluid channel 101 and flows from the upstream end of the heater 400 through the downstream end of the heater 400, then flows along the first fluid channel 101 and reaches the first fluid outlet 222. Therefore, the heater 400 may selectively heat up the fluid in the first fluid channel 101 directly. Furthermore, the other fluid flowing through the second fluid channel 201 may also be heated up indirectly by the heater 400.

The over-temperature structure in the present embodiment includes a first over-temperature protector 500 and the main body 200 and heater 400 described above. The first over-temperature protector 500 is arranged inside the heater 400. The first over-temperature protector 500 is configured to disconnect access of power source to the heater 400 once the temperature in the heater 400 is over a first preset value.

In the over-temperature protection structure of the hair drying apparatus 10 provided by the embodiment, the first over-temperature protector is arranged inside the heater 400, therefore, when the temperature of the heater is relatively high, the heater 400 and the power source will be disconnected and the heater 400 will cease to work, avoiding damaging the heater 400 and surrounding elements because of overheat, thereby protecting the whole over-temperature protection structure and the hair drying apparatus 10. The first over-temperature protector 500 of the hair drying apparatus 10 is arranged inside the heater 400, therefore, the temperature standard for disconnecting the power source for the first over-temperature protector 500 is the temperature inside the heater 400, thereby revealing the temperature of the heater 400 more vividly, which improves safety and use performances of the hair drying apparatus 10.

The fluid channel of the over-temperature protection structure of the present embodiment is the second section 105 formed in the main body 200 of the first fluid channel 101.

Figure 3:
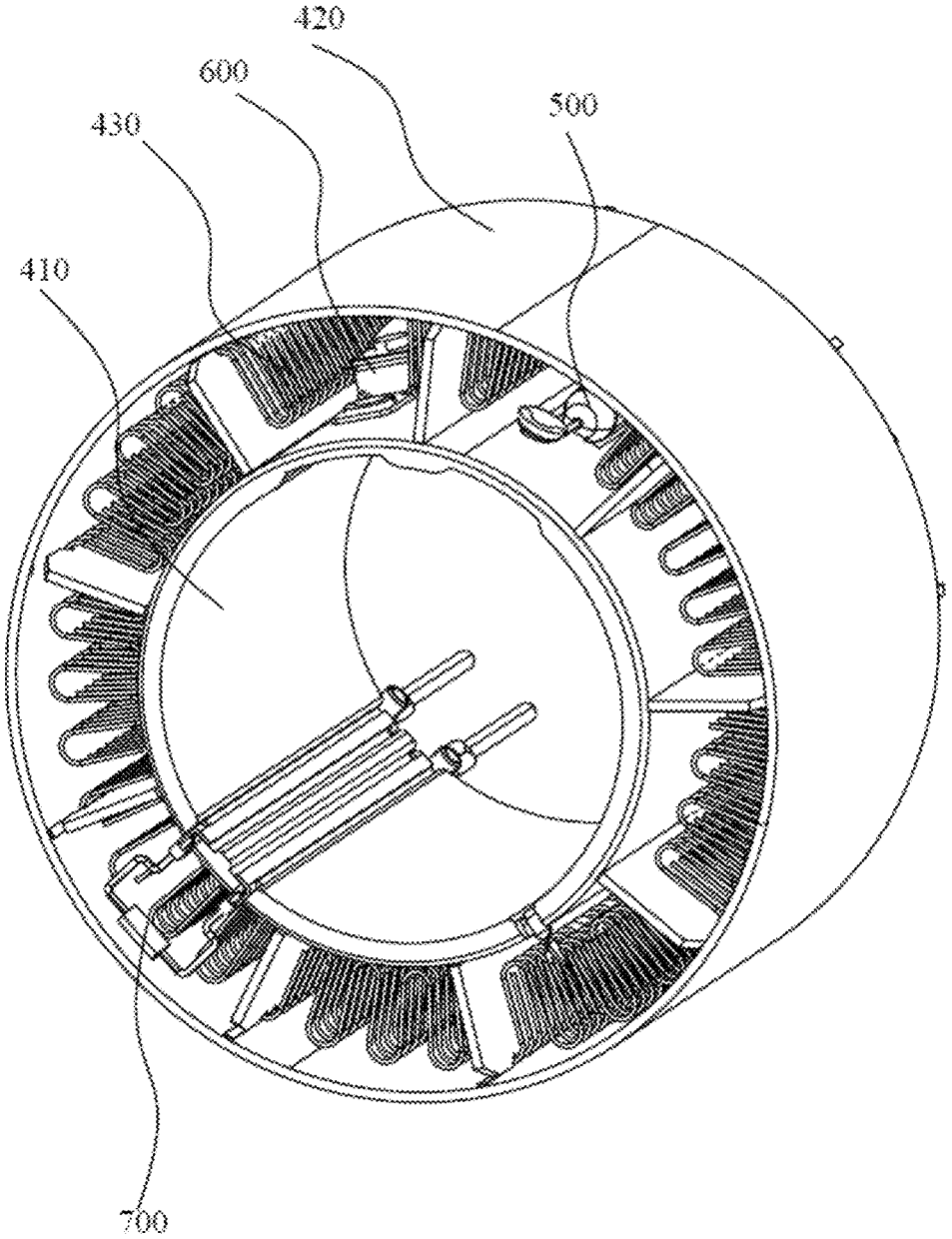
FIG. 3 is a schematic view of a heater of the hair drying apparatus according to an embodiment.

As shown in FIG. 3, the heater 400 includes an inner layer 410, an outer layer 420 and a heating element 430. The heating element 430 is arranged between the inner layer 410 and the outer layer 420. The inner layer 410 is arranged on an inner side of the heating element 430 and configured to support the heating element 430.

However, in alternative embodiments, the heater 400 may omit the outer layer 430 arranged on an outer side of the heating element 430.

Figure 7:
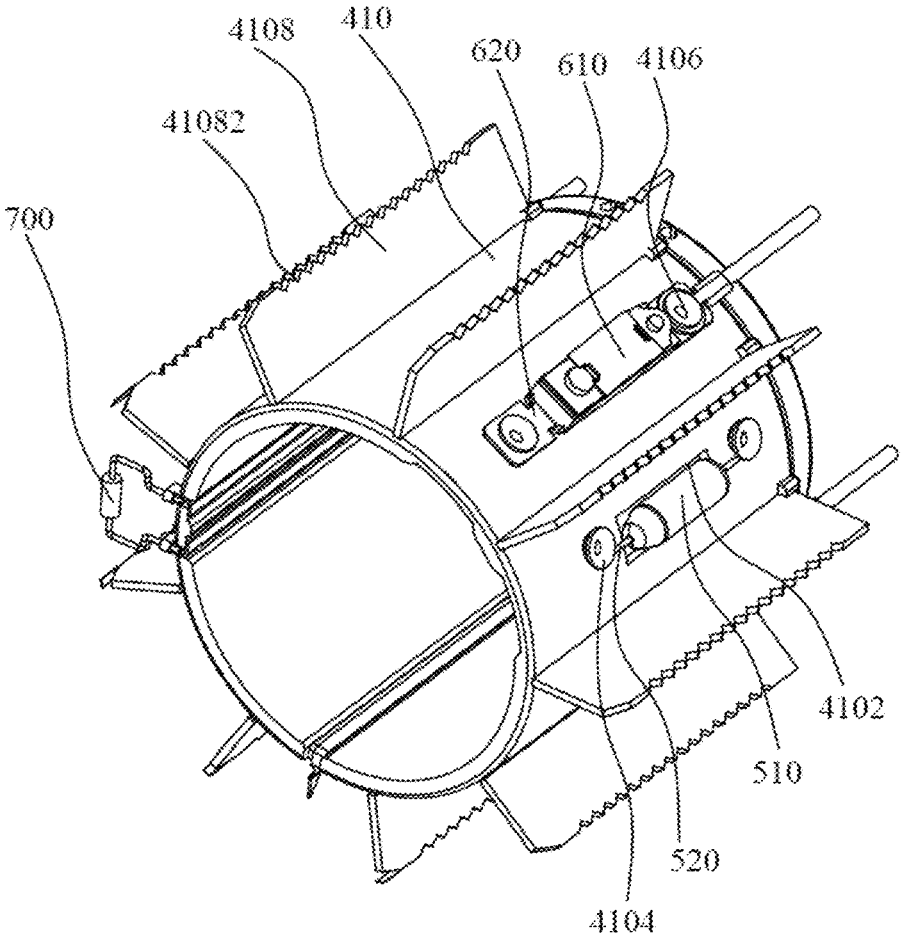
FIG. 7 is a structural schematic view of an inner layer of the hair drying apparatus according to an embodiment.

As shown in FIG. 7, the inner layer 410 is configured with a first mounting hole 4102 passing though the wall of the inner layer 410. The first over-temperature protector 500 includes a first temperature detection element 510 and a first connector 520 connected to the first temperature detection element 510. An outer wall of the inner layer 410 is configured with a first mounting column 4104. Two first connectors 520 and two first mounting columns 4104 are provided. The two first connectors 520 are respectively connected to two ends of the first temperature detection element 510. The first connectors 520 are fixed to corresponding first mounting columns 4104, such that the first temperature detection element 510 may suspend inside the first mounting hole 4102. Preferably, the first temperature detection element 510 is at least in part arranged on the inner side of the inner wall of the inner layer 410. Therefore, the first over-temperature protector 500 detects temperature inside the inner layer 410. When the hair drying apparatus 10 is in use in the present embodiment, the temperature of the heater 400 will be revealed vividly, improving safety and use performances of the hair drying apparatus 10.

As shown in FIGS. 2, 3 and 7, the over-temperature protection structure further includes a second over-temperature protector 600, the second over-temperature protector 600 arranged inside the heater 400. Where the second over-temperature protector 600 is configured to disconnect access of the power source to the heater 400 if temperature inside the heater 400 is higher than a second preset value, and reconnect the heater 400 and the power source if the temperature inside the heater 400 is lower than the second preset value; the second preset value is lower than the first preset value.

In the present embodiment, the first over-temperature protector 500 includes but not limited to a thermofuse. The second over-temperature protector 600 may be temperature switch, a metal dome, etc.

As shown in FIGS. 2, 3 and 7, the second over-temperature protector 600 is arranged on an outer wall of the inner layer 410. The second over-temperature protector 600 includes a second temperature detection element 610 and a second connector 620 connected to the second temperature detection element 610; an outer wall of the inner layer 410 is arranged with a second mounting column 4106. Two second connectors 620 and two second mounting columns 4106 are provided. The two second connectors 620 are respectively connected to two ends of the second temperature detection element 610. The second connectors 620 are fixed to corresponding second mounting columns 4106, in which the second temperature detection element 610 is exposed to the outer wall of the inner layer 410. Therefore, the temperature between the inner layer 410 and the heating element 430 acts as a temperature standard for the second over-temperature protector 600 to determine to disconnect or connect the heater 400 and the power source.

Figure 8:
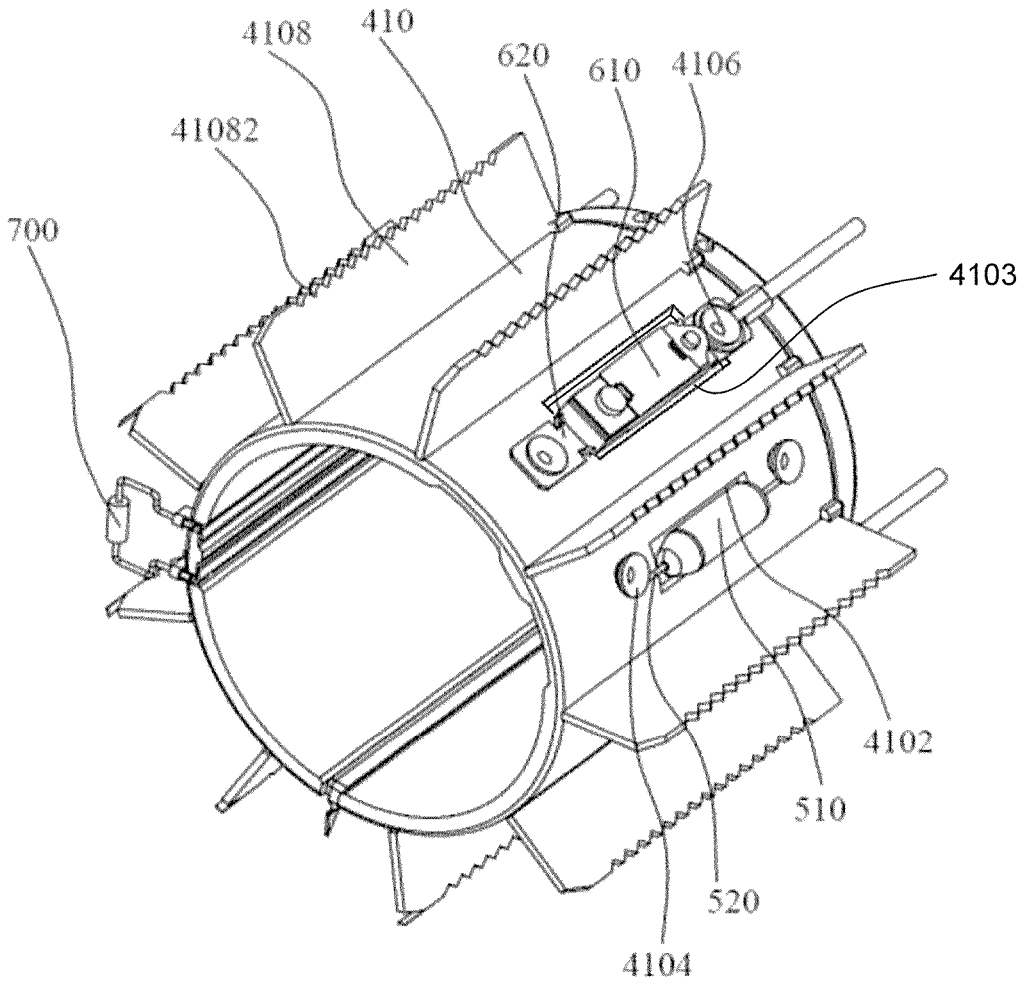
FIG. 8 is a structural schematic view of an inner layer of the hair drying apparatus according to another embodiment.

However, in alternative embodiments, as shown in FIG. 8, the second over-temperature protector 600 may also be arranged similar to the first over-temperature protector 500. For example, an outer wall of the inner layer 410 is arranged with a second mounting hole 4103. The second temperature detection element 610 of the second over-temperature protector 600 may suspend inside the second mounting hole 4103. Therefore, the temperature inside the inner layer 410 acts as a temperature standard for the second over-temperature protector 600 to determine to disconnect or connect the heater 400 and the power source.

Alternatively, the first temperature detection element 510 of the first over-temperature protector 500 is exposed to an outer wall of the inner layer 410, therefore, the temperature between the heating element 430 and the inner layer 410 acts as a temperature standard for the first over-temperature protector 500 to determine to disconnect heater 400 and the power source. Particular mounting way for the first over-temperature protector 500 doses not limit that for the second over temperature protector 600, and vice versa, which means the particular mounting ways for the first over-temperature protector 500 may be same or not with that for the second over-temperature protector 600.

Specifically, in one embodiment, the inner layer 410 is made of plastic material. Compared with mica material, plastic material possesses better plastic performance with greater hardness, and is easier to set the inner layer 410, which is for supporting the heating element 430, to alternative shapes and fixed to. Furthermore, it is convenient for the inner layer 410 to provide a first mounting hole 4102 and a second mounting hole 4103, thereby mounting and fixing the first over-temperature protector 500 and the second over-temperature protector 600 to the heater 400, improving bearing adaptability of the heater 400 substantially. T insulation material; preferably, the outer layer 420 is made of mica.

The first over-temperature protector 500 and the second over-temperature protector 600 are normally not affected by the fluid medium flowing through the first fluid channel 101. However, when the temperature of the heater 400 is over or equal to the second preset value because of block or other abnormal conditions occurred in the first fluid channel 101, in other words, the temperature inside the heater 400 is over or equal to the second preset value, the second over-temperature protector 600 will disconnect access of power source to the heater 400. When the block or other abnormal conditions are eliminated, and the temperature in the heater 400 falls below the second preset value, the second over-temperature protector 600 will reconnect the access of the power source to the heater 400, and the hair drying apparatus 10 may return to service.

When the second over-temperature protector 600 is not working, the temperature in the heater 400 would be over the second preset value for block or other abnormal conditions occurred in the first fluid channel 101, and the first over-temperature protector 500 will disconnect access of power source to the heater 400, thereby protecting the heater 400 and elements surrounding the heater 400.

In the present embodiment, the heater 400 is connected to a controller. The controller is arranged in the first fluid channel 101. The first temperature detection element 510 of the first over-temperature protector 500 is connected to the controller via the first connector 520 and a wire. The second temperature detection element 610 of the second over-temperature protector 600 is connected to the controller via the second connector 620 and a wire. Specifically, both the first over-temperature protector 500 and the second over-temperature protector 600 are arranged at a route connecting the heater 400 and the controller. The power source provides the heater 400 with power via the controller, such that the first over-temperature protector 500 may disconnect or reconnect the access of the power source to heater 400; furthermore, the second over-temperature protector 600 may disconnect or reconnect the access of the power source to heater 400.

In the embodiment as shown in FIGS. 3 to 7, the hair drying apparatus 10 further includes a temperature detector 700 electrically connected to the controller. The controller may control heating temperature of the heater 400 based on a detection result of the temperature detector 700.

As shown in FIG. 7, a supporter 4108 is arranged on the outer wall of the inner layer 410. The heating element 430 is erected on the supporter 4108. The heating element 430 includes a plurality of heating wires. There exist a plurality of supporters, and the heating wires are respectively erected on the supporters 4108 correspondingly.

Specifically, the inner layer 410 and the outer layer 420 are both cylinders. The plurality of supporters 4108 are arranged at intervals along a circumferential direction of the inner layer 410. The supporters 4108 extend along an axial direction of the inner layer 410. The supporters 4108 include a plurality of locating slots 41082 extending along a radial direction of the inner layer 41082. The plurality of heating wires are arranged at intervals along an axial direction of the inner layer 410. Locating elements 4302 contained in the locating slots 41082 are formed on the heating wires.

Figure 4:
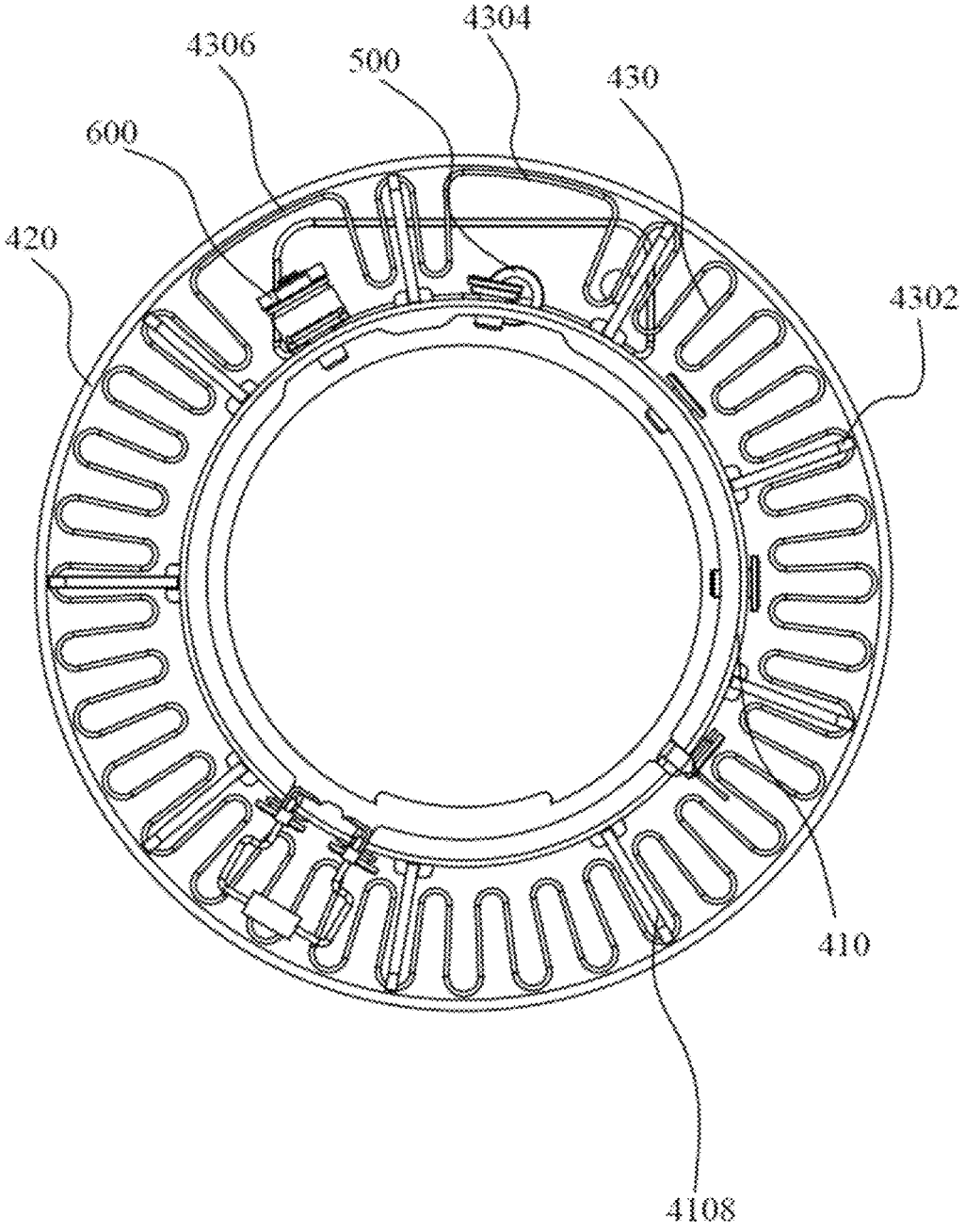
FIG. 4 is a side view of the FIG. 3.
Figure 5:
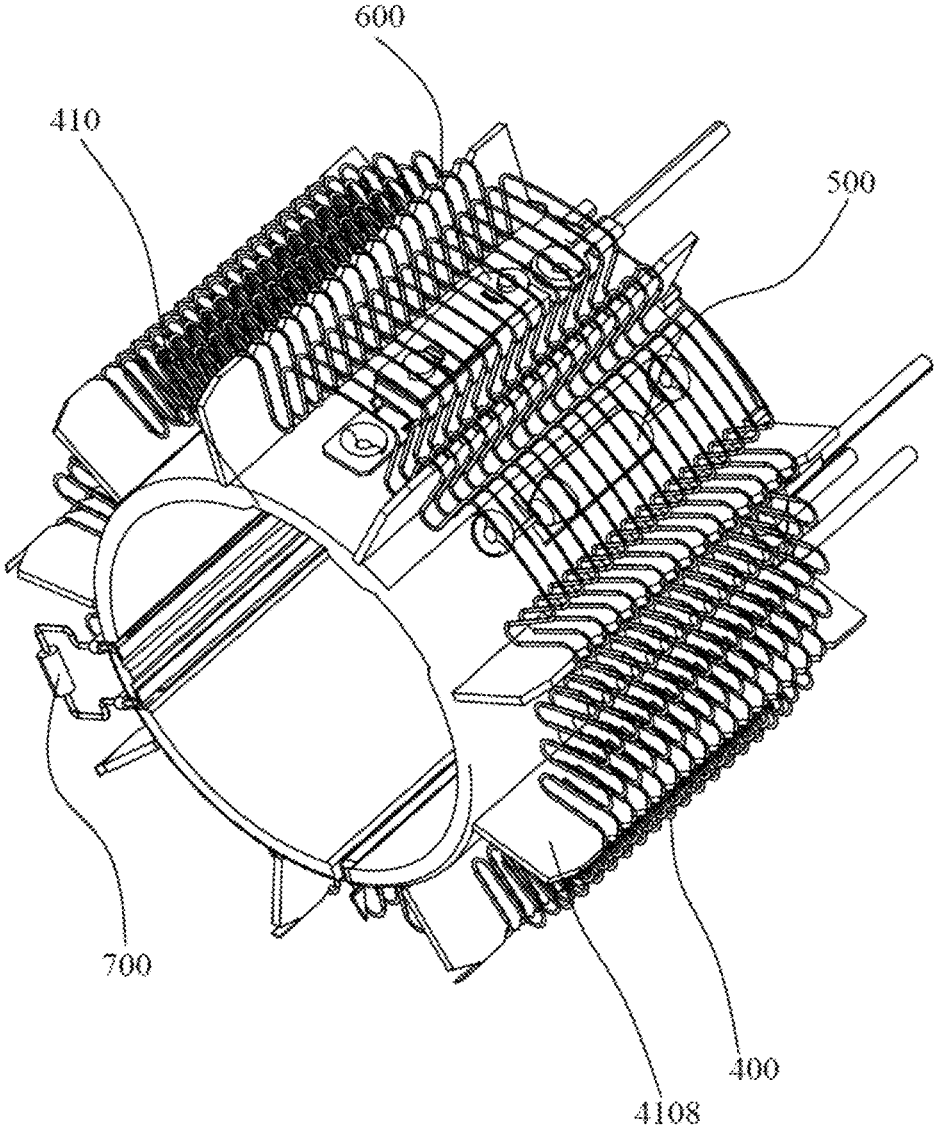
FIG. 5 is a structural schematic view of the heater of the hair drying apparatus, without an outer layer, according to an embodiment.
Figure 6:
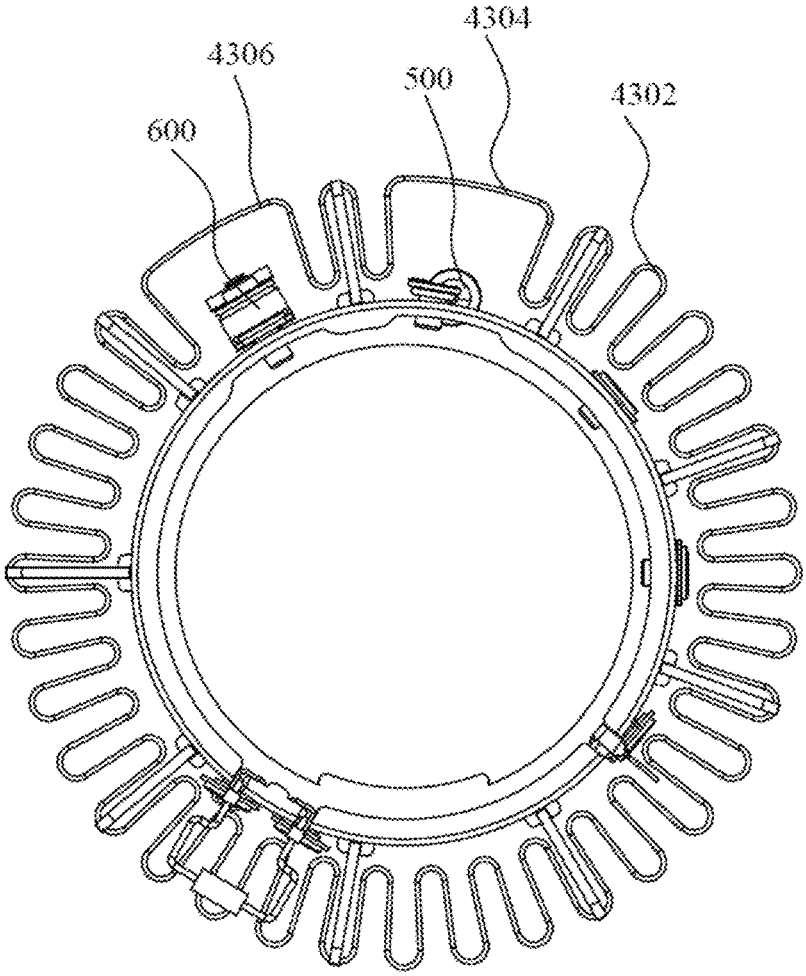
FIG. 6 is a side view of the FIG. 5.

As shown in FIGS. 4 and 6, a first avoidance space 4304 for containing the first over-temperature protector 500 and a second avoidance space 4306 for containing the second over-temperature protector 600 are formed on the heating wires. Specifically, the first avoidance space 4304 is a first U-shape structure with an opening facing the inner layer 410 formed on the heating wires; the second avoidance space 4306 is a second U-shape structure with an opening facing the inner layer 410 formed on the heating wires. The first over-temperature protector 500 is arranged inside the opening of the first U-shape structure. The second over-temperature protector 600 is arranged inside the opening of the second U-shape structure.

However, in alternative embodiments, the first avoidance space 4304 may also be a semicircular structure or a semi-elliptic structure with an opening facing the inner layer 410 formed on the heating wires; similarly, the second avoidance space 4306 may also be a semicircular structure or a semi-elliptic structure with an opening facing the inner layer 410 formed on the heating wires. Where specific implementations of the first avoidance space 4304 and the second avoidance space 4306 may be the same or not.

As shown in FIG. 7, at least one supporter 4108 is arranged between the first U-shape structure and the second U-shape structure along the circumferential direction of the inner layer 410. The heating wires are provided with at least one locating element 4302 arranged between the first U-shape structure and the second U-shape structure, which means the first U-shape structure and the second U-shape structure may be arranged adjacently or separately. When the first U-shape structure and the second U-shape structure are arranged adjacently, a support frame is arranged between the first U-shape structure and the second U-shape structure for stiffening structural strength of the first U-shape structure and the second U-shape structure, which ensures that at least one supporter 4108 is arranged between the first avoidance space 4304 and the second avoidance space 4306 along the circumferential direction of the inner layer 410.

The above embodiments are merely for illustrating several embodiments of the present invention, and the description thereof is more specific and detailed. However, this should not be deemed as constructing limitation of the scope of the invention. It should be noted that numerous variations and modifications may be made by those skilled in the art without departing from the spirit and scope of the invention. Therefore, the scope of the invention should be determined by the appended claims.

What is claimed is:

1. An over-temperature protection structure, applied to a hair drying apparatus, comprising a main body, a heater and a first over-temperature protector, a fluid channel being formed inside the main body, the heater being arranged inside the fluid channel and configured to heat up fluid medium inside the fluid channel;

the heater includes an inner layer and a heating element, the inner layer being arranged on an inner side of the heating element and configured to support the heating element, the first over-temperature protector being arranged between the inner layer and the heating element, wherein the inner layer is a plastic layer and configured with a first mounting hole, and the first over-temperature protector is arranged in the first mounting hole.

2. The over-temperature protection structure of claim 1, wherein an outer wall of the inner layer is configured with a first mounting column; the first over-temperature protector includes a first temperature detection element and a first connector connected to the first temperature detection element, the first temperature detection element arranged inside the first mounting hole, the first connector connected to the first mounting column.

3. The over-temperature protection structure of claim 1, wherein the over-temperature protection structure further includes a second over-temperature protector, the second over-temperature protector arranged on the inner side of the heating element.

4. The over-temperature protection structure of claim 3, wherein the first over-temperature protector is configured to cut off connection between the heater and a power source if temperature inside the heater is higher than a first preset value; the second over-temperature protector is configured to cut off connection between the heater and the power source if temperature inside the heater is higher than a second preset value, and reconnect the heater and the power source if temperature inside the heater is lower than the second preset value;

the second preset value is lower than the first preset value.

5. The over-temperature protection structure of claim 4, wherein the inner layer is configured with a second mounting hole, the second over-temperature protector arranged inside the second mounting hole.

6. The over-temperature protection structure of claim 5, wherein an outer wall of the inner layer is arranged with a second mounting column; the second over-temperature protector includes a second temperature detection element and a second connector connected to the second temperature detection element; the second temperature detection element is arranged inside the second mounting hole, the second connector connected to the second mounting column.

7. The over-temperature protection structure of claim 3, wherein an outer wall of the inner layer is configured with a supporter, the heating element erected on the supporter.

8. The over-temperature protection structure of claim 7, wherein the inner layer is a cylinder; a plurality of supporters are provided; the heating element includes a plurality of heating wires; the plurality of supporters are arranged at intervals along a circumferential direction of the inner layer; the supporters extend along an axial direction of the inner layer; the supporters include a plurality of locating slots extending along a radial direction of the inner layer;

the plurality of heating wires are arranged at intervals along an axial direction of the inner layer, locating elements contained in the locating slots are formed on the heating wires.

9. The over-temperature protection structure of claim 8, wherein a first avoidance space for containing the first over-temperature protector is arranged on the heating wires.

10. The over-temperature protection structure of claim 9, wherein a second avoidance space for containing the second over-temperature protector is arranged on the heating wires.

11. The over-temperature protection structure of claim 10, wherein at least one of the supporters are arranged between the first avoidance space and the second avoidance space along a circumferential direction of the inner layer, the heating wires arranged on at least one of the locating elements arranged between the first avoidance space and the second avoidance space.

12. The over-temperature protection structure of claim 1, wherein the heater further includes an outer layer, the heating element arranged between the inner layer and the outer layer.

13. A hair drying apparatus, comprising an over-temperature protection structure which includes:

a main body, a heater and a first over-temperature protector, a fluid channel being formed inside the main body, the heater being arranged inside the fluid channel and configured to heat up fluid medium inside the fluid channel;

the heater includes an inner layer and a heating element, the inner layer being arranged on an inner side of the heating element and configured to support the heating element, the first over-temperature protector being arranged between the inner layer and the heating element, wherein the inner layer is a plastic layer and configured with a first mounting hole, and the first over-temperature protector is arranged in the first mounting hole.

* * * * *